US010292541B2

(12) United States Patent
Kublin

(10) Patent No.: US 10,292,541 B2
(45) Date of Patent: May 21, 2019

(54) SHOWER HEAD HANGER

(71) Applicant: Brett L. Kublin, Fort Lauderdale, FL (US)

(72) Inventor: Brett L. Kublin, Fort Lauderdale, FL (US)

( * ) Notice: Subject to any disclaimer, the term of this patent is extended or adjusted under 35 U.S.C. 154(b) by 0 days.

(21) Appl. No.: 15/682,791

(22) Filed: Aug. 22, 2017

(65) Prior Publication Data

US 2018/0055293 A1 Mar. 1, 2018

Related U.S. Application Data

(60) Provisional application No. 62/378,366, filed on Aug. 23, 2016.

(51) Int. Cl.

| | |
|---|---|
| ***A47F 5/00*** | (2006.01) |
| ***A47G 25/06*** | (2006.01) |
| ***A47G 25/14*** | (2006.01) |
| ***A47K 10/08*** | (2006.01) |
| ***D06F 57/12*** | (2006.01) |

(52) U.S. Cl.

CPC ..... *A47K 10/08* (2013.01); *A47G 25/06* (2013.01); *A47G 25/14* (2013.01); *D06F 57/12* (2013.01); *A47F 5/00* (2013.01)

(58) Field of Classification Search

CPC ..... A47K 10/08; A47K 1/02; A47K 3/281; A47K 10/04; A47K 7/00; A47G 25/14; A47G 29/08; A47G 25/0685; A47G 25/0607; D06F 57/12; A47F 5/00; A47F 7/0021; A47F 5/0006; F16B 2/22; F16B 2/20; A47B 81/02; A47L 13/512; A47L 13/51; A46B 17/02; A46B 17/06; B44D 3/123; A47J 47/20; A47J 47/16; E03C 1/06; E03C 1/04; B05B 1/18; B05B 1/185; A61H 9/0021

USPC ..... 211/119.011, 119.009, 123, 124, 211/105.1–105.6, 99, 100, 197; 4/569, 4/570, 601, 615

See application file for complete search history.

(56) References Cited

U.S. PATENT DOCUMENTS

| | | | | | |
|---|---|---|---|---|---|
| 743,623 | A * | 11/1903 | Dinneen | E03C 1/0408 | 137/602 |
| 1,069,643 | A | 8/1913 | Inden | | |
| 1,394,383 | A * | 10/1921 | Whitmore | F16K 51/00 | 248/213 |
| 2,060,100 | A * | 11/1936 | Michelson | A47K 3/28 | 239/110 |
| 2,941,671 | A * | 6/1960 | Lewis | A47G 25/08 | 211/119.009 |
| 2,997,182 | A * | 8/1961 | Lewis | A47K 10/08 | 211/119.009 |
| 3,024,564 | A * | 3/1962 | Schmidt | A47K 1/09 | 211/119.009 |

(Continued)

*Primary Examiner* — Jennifer E. Novosad

(74) *Attorney, Agent, or Firm* — Robert M. Schwartz; Alfred K. Dassler

(57) ABSTRACT

A shower head assembly includes a pipe section for attaching between a shower pipe and a shower head. The pipe section includes a mounting block disposed thereon. The mounting block has a recess formed therein. A hanger arm is configured to be inserted into the recess to be removably attached to the pipe section and held by the pipe section in a non-vertical orientation. The hanger arm supports hangers for hanging items such as clothes.

12 Claims, 7 Drawing Sheets

(56) References Cited

U.S. PATENT DOCUMENTS 3,266,764 A * 8/1966 Briles ..... A47K 3/281 248/213
3,307,710 A * 3/1967 Negri ..... A47G 25/06 211/119.009
3,375,532 A * 4/1968 Gellmann ..... E03C 1/06 4/570
3,813,072 A * 5/1974 Moore ..... A47K 5/1214 211/74
D235,830 S * 7/1975 Kollitz ..... D6/327
D235,831 S 7/1975 Kollitz
3,982,284 A * 9/1976 Becker ..... A47K 4/00 248/150
3,982,285 A * 9/1976 Roberts, Jr. ..... E03C 1/06 4/605
D245,134 S * 7/1977 Friedberg ..... D6/324
4,282,612 A * 8/1981 King ..... B05B 15/60 4/601
D278,106 S 3/1985 Green
4,752,975 A * 6/1988 Yates ..... E03C 1/06 239/207
4,809,369 A * 3/1989 Bowden ..... A47K 3/32 4/615
4,819,812 A 4/1989 Demarest, Jr.
4,933,080 A * 6/1990 Rundzaitis ..... B01D 35/043 210/232
5,185,893 A * 2/1993 Lin ..... E03C 1/023 137/597
5,274,860 A * 1/1994 Avila ..... A47K 3/28 4/605
D347,262 S * 5/1994 Black ..... D23/230
5,331,694 A 7/1994 Mackenzie et al.
5,749,552 A * 5/1998 Fan ..... E03C 1/06 248/205.8
6,079,060 A * 6/2000 Walker ..... B05B 1/14 4/601
6,233,756 B1 * 5/2001 Holbrook, Sr. ..... E03C 1/046 239/312
6,415,461 B1 7/2002 Singer
6,643,862 B2 * 11/2003 Aitken ..... E03C 1/0408 4/601
7,793,365 B2 * 9/2010 Miura ..... E03C 1/0403 137/360
7,905,429 B2 * 3/2011 Somerfield ..... E03C 1/046 137/101.11
D670,025 S * 10/2012 Touzjian ..... D27/194
8,893,320 B2 * 11/2014 Klicpera ..... B05B 12/004 4/601
9,700,909 B2 * 7/2017 Leber ..... E03C 1/06
2005/0082245 A1 4/2005 Arjomand
2006/0272086 A1 * 12/2006 Mesa ..... A47K 3/28 4/601
2007/0209108 A1 * 9/2007 Shorr ..... E03C 1/06 4/601
2009/0265848 A1 * 10/2009 Tsai ..... E03C 1/0408 4/615
2013/0283520 A1 10/2013 Schulte

* cited by examiner

SHOWER HEAD HANGER

CROSS REFERENCE TO RELATED APPLICATIONS

This application claims benefit of U.S. Provisional Patent Application No. 62/378,366 filed Aug. 23, 2016, entitled Shower Head Hanger, the disclosure of which is incorporated herein by reference in its entirety.

FIELD OF THE INVENTION

The present invention relates to shower augmentations, and more particularly to a shower head hanger for hanging items.

BACKGROUND OF THE INVENTION

It is common for items to require hanging. For example, wet clothing may require hanging to air-dry. Wet clothing may be wrung-out or spun in a washer or dryer to remove enough liquid to allow a user to handle the clothing without dripping water on the floor while transferring the wet clothing for hanging. For example, a user may wring out or spin-dry wet clothing before transferring the clothing to a hanging rack, which may be located outdoors, or even indoors if enough liquid can be removed from the clothing prior to transfer.

However, a user may not be able to initially remove enough liquid from wet clothing to conveniently transfer the wet clothing to a hanging rack without dripping water on the floor of their home. For example, a user may not have a clothes washer or dryer to spin the clothing, may not want to damage delicate clothing by twisting to wring-out the wet clothing, or may be too weak to wring out wet clothing.

Perhaps one solution would be to place a clothes hanging rack near a sink or bathtub, where the user may hand-wash clothing and attempt to transfer soaked clothes to the hanging rack without dripping too much liquid, and so that dripped liquid may be located in bathroom areas instead of living areas of the home. But, hanging racks may be too large and awkward to fit in small or even medium sized bathrooms, and require dedicated storage space. Further, this solution does not prevent water from dripping on the floor.

Various patents have been filed that attempt to allow users to hang wet clothing in a shower, to remedy the above issues. For example, U.S. Pat. No. 2,941,671 ('671) describes a drip-dry clothing support device configured to attach to a shower pipe. However, the device of '671 has a major problem; the bracket arm is configured to rotate about an axis, and is therefore weak at such axis, and wet clothing (e.g. a soaked wool jacket) may be too heavy for the configuration of '671. Further, in moist environments such as bathrooms, the components that provide the rotation axis will undoubtedly rust and deteriorate, and require frequent cleaning and replacement.

Therefore, there exists a need for an improved hanging device that allows a user to hang wet items in a shower.

BRIEF SUMMARY OF THE INVENTION

In one embodiment, disclosed is a shower head assembly comprising, a pipe section having a first end with a threaded female connection for attaching to a shower pipe and a second end with a threaded male connection for attaching a shower head device, said pipe section including a mounting block disposed thereon, said mounting block having a recess formed therein, and a hanger arm having a longitudinal axis extending along a length direction of said hanger arm, a cross section of said hanger arm taken across said longitudinal axis having a profile corresponding to a recess cross section profile for permitting said hanger arm for being inserted into said recess and held therein.

In another aspect, said recess opens out of said mounting block at a longitudinal end of said recess and along one longitudinal side of said recess.

In another aspect, said hanger arm has a longitudinal end with an enlarged cross section, said recess having a second longitudinal end having an enlarged cross section corresponding to said enlarged cross section of said hanger arm.

In another aspect, said enlarged cross section is taken perpendicular to said longitudinal axis.

In another aspect, said enlarged cross section is taken parallel to said longitudinal axis.

In another aspect, said hanger arm has notches formed therein for seating a hanger.

In another embodiment, disclosed is a shower head assembly comprising, a clamp for externally clamping onto a shower pipe, said clamp including a mounting block disposed thereon, said mounting block having a recess formed therein, and a hanger arm having a longitudinal axis extending along a length direction of said hanger arm, a cross section of said hanger arm taken across said longitudinal axis corresponding to a recess cross section profile for permitting said hanger arm to be inserted into said recess and held therein.

DETAILED DESCRIPTION OF THE INVENTION

Figure 1:
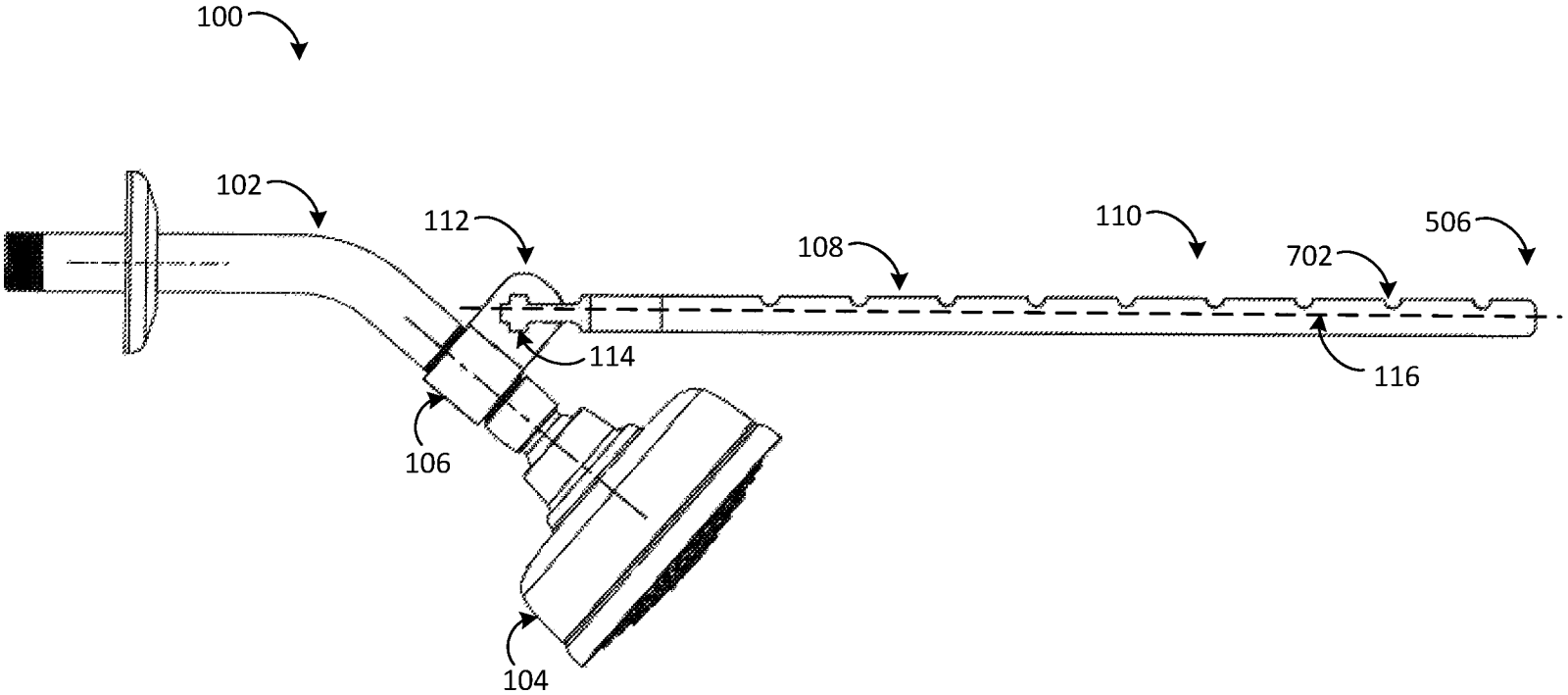
FIG. 1 shows a side view of the shower head hanger, where a hanger arm is inserted into a pipe section, in accordance with embodiments of the present disclosure.

Disclosed is a shower head assembly 100 that allows a user to hang items such as clothes hangers and clothing from the shower head assembly 100. As shown in FIG. 1, the shower head assembly 100 attaches to an existing or conventional shower pipe 102 (e.g. a pipe passing through a wall in a bathroom that a shower head device 104 attaches to). The shower head assembly 100 is configured to seat or support one or more conventional clothes hangers for hanging clothes on the shower head assembly 100.

As further shown in FIG. 1, the shower head assembly 100 may include a pipe section 106 that is configured to attach to the shower pipe 102, and receive a hanger arm 108 that is removably insertable into or removably attachable to the pipe section 106 such that the hanger arm 108 is holdable, or supported in, a horizontal or generally non-vertical orientation 110 against the force of gravity by the pipe section 106 for receiving, supporting, or seating one or more clothes hangers or hooks on the hanger arm 108, while the pipe section 106 is attached to the shower pipe 102 and while the hanger arm 108 is adopting the non-vertical orientation.

Figure 3:
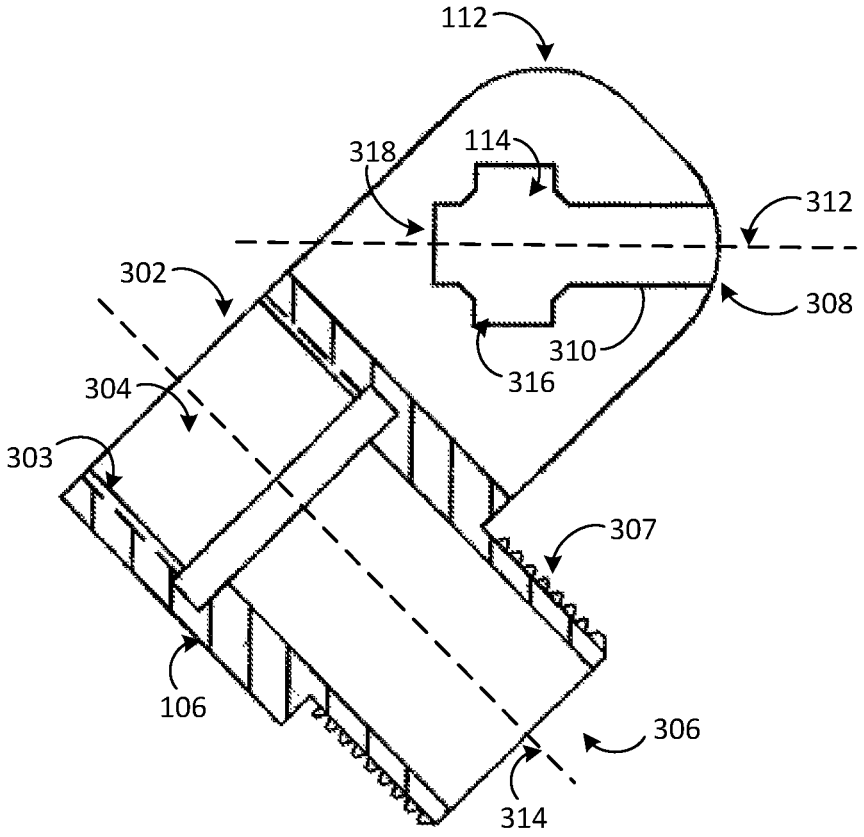
FIG. 3 shows a sectional view of the pipe section, where the section is taken along sectional plane 3-3 in FIG. 4, in accordance with embodiments of the present disclosure.
Figure 4:
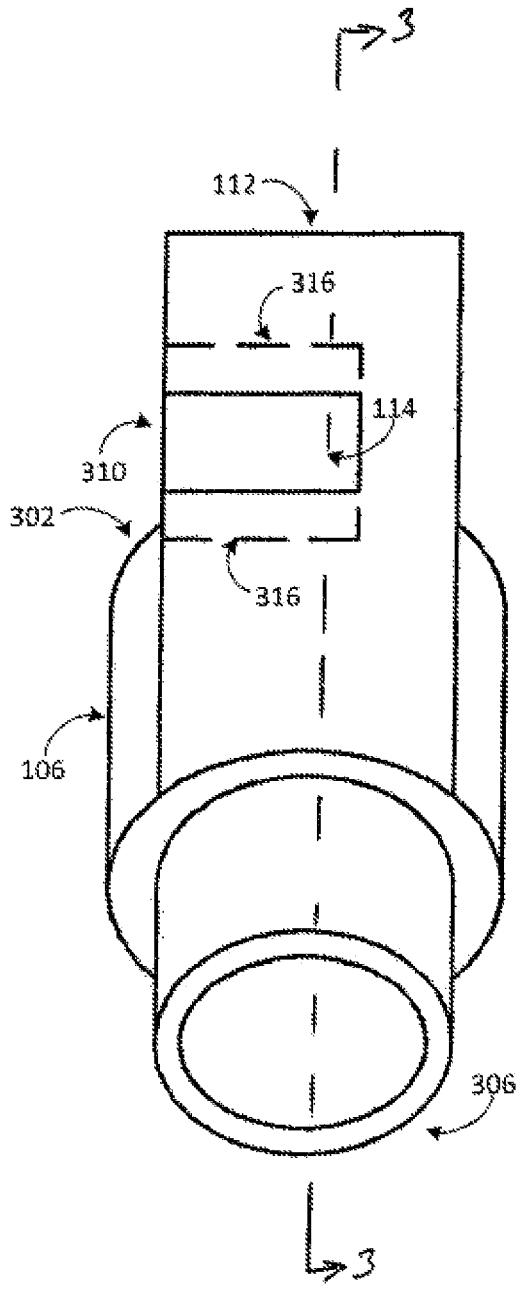
FIG. 4 shows a top view of the hanger arm and the pipe section, showing the sectional plane 3-3, in accordance with embodiments of the present disclosure.

Turning to FIGS. 3 and 4, the pipe section 106 may have a first end 302, the first end 302 having a threaded female connection 303 for attaching the pipe section 106 to the shower pipe 102. It is to be understood that the pipe section 106 may be connectable to the shower pipe 102 via any appropriate method. The pipe section 106 may attach to the shower pipe 102 such that water flowing through the shower pipe 102 continuously flows through the pipe section 106, from one open end of the pipe section 106 to an opposite open end of the pipe section 106. As such, the pipe section 106 may be attachable to the shower pipe 102 such that an internal space 304 or bore of the pipe section 106 remains in fluid connection with the shower pipe 102 such that received water from the shower pipe 102 flows directly through the pipe section 106.

As further shown in FIGS. 3 and 4, the pipe section 106 may have a second end 306, the second end 306 having a threaded male connection 307 for attaching the pipe section 106 to a shower head device 104 (FIG. 1). For example, an appropriate shower head device 104 may be a conventional or existing shower head that is configured to spray water flowing through the shower pipe 102 for consumption or showering. As such, the second end 306 of the pipe section 106 may have an identical thread or attachment mechanism of the shower pipe 102 such that a standard shower head device 104 fits on the pipe section 106. It is to be understood that any appropriate attachment mechanism may allow the pipe section 106 to be attached to the shower head device 104. Further, it is to be understood that the shower pipe 102, the pipe section 106, and the shower head device 104 may be fluidly connectable such that water flowing through the shower pipe 102 flows through the pipe section 106 and subsequently through the shower head device 104 for consumption or showering. As such the pipe section 106 attaches between the shower head device 104 and the shower pipe 102.

Figure 2:
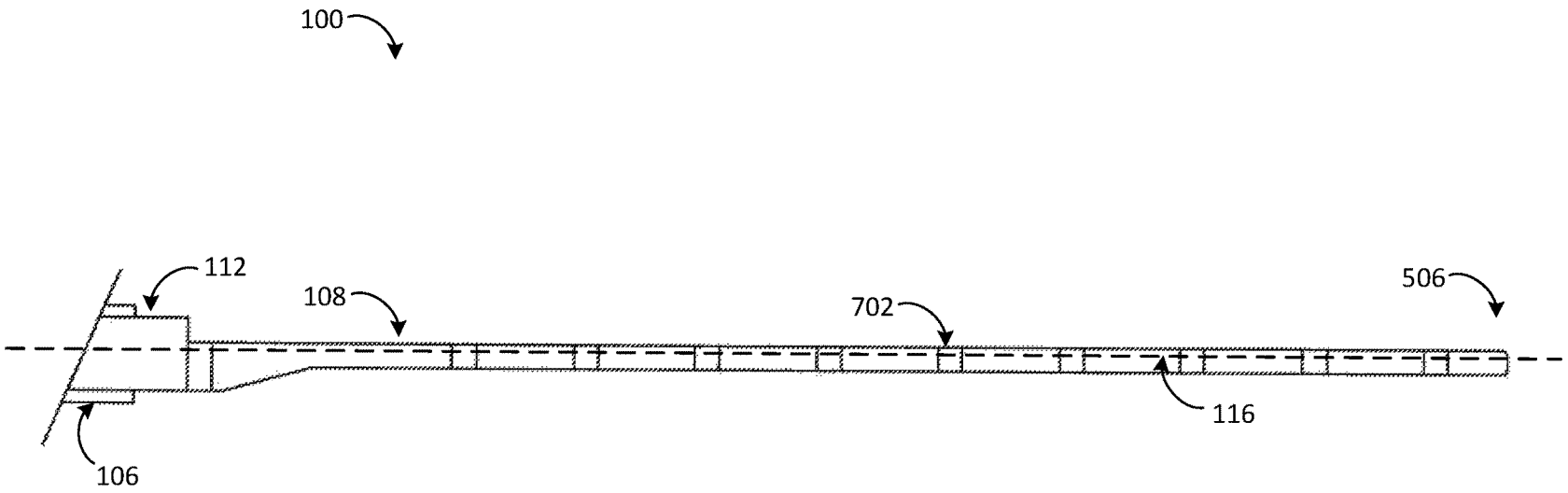
FIG. 2 shows a top view of the hanger arm while the hanger arm is inserted into the pipe section, in accordance with embodiments of the present disclosure.
Figure 5:
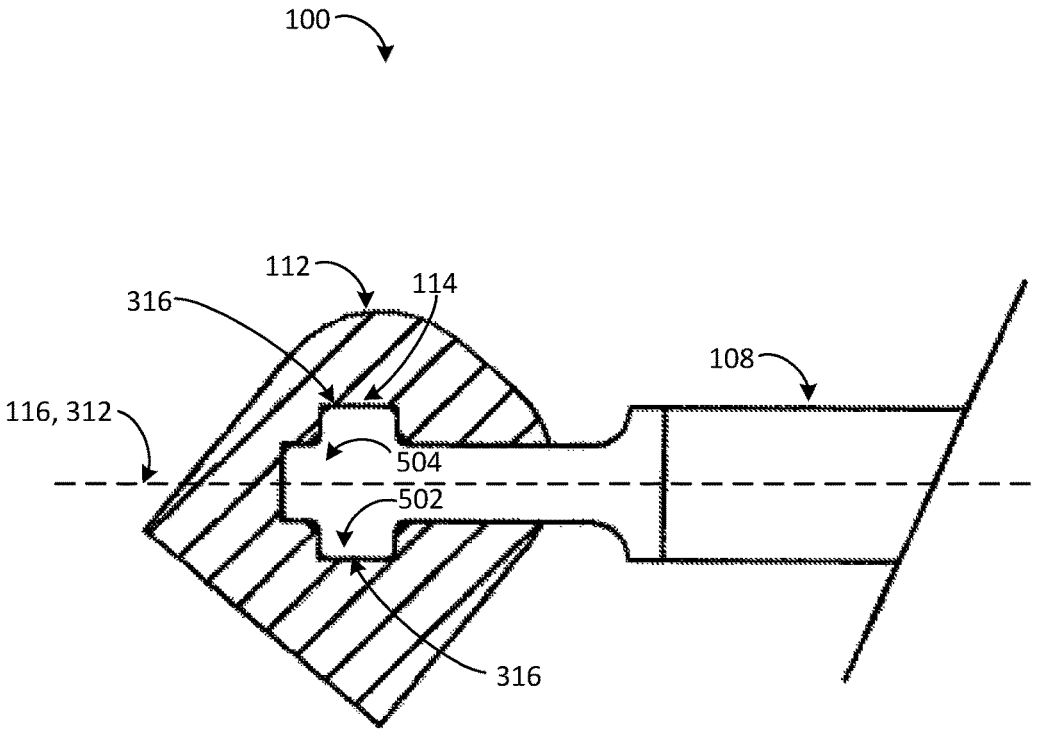
FIG. 5 shows a partial view of the pipe section and the hanger arm, where the hanger arm (not in section) is inserted into the pipe section, and where the section is taken along sectional plane 3-3 in FIG. 4, in accordance with embodiments of the present disclosure.
Figure 6:
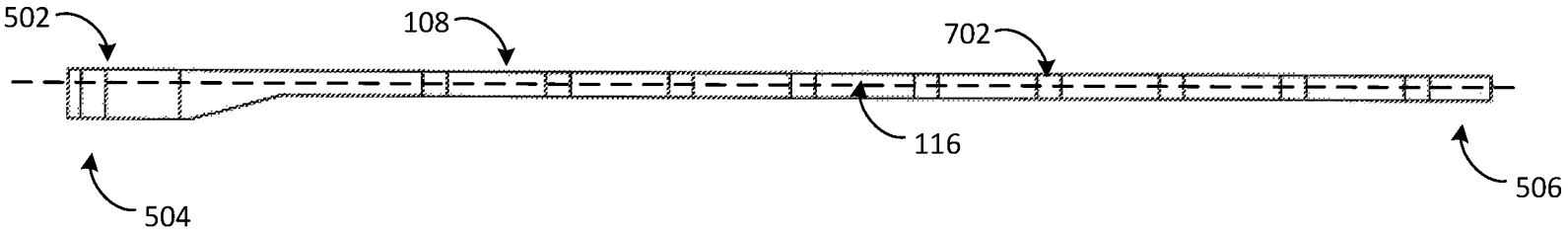
FIG. 6 shows a top view of the hanger arm, in accordance with embodiments of the present disclosure.
Figure 7:
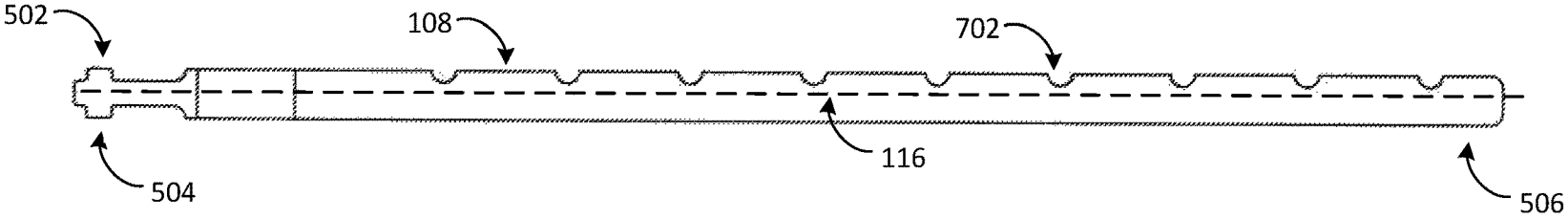
FIG. 7 shows a side view of the hanger arm, in accordance with embodiments of the present disclosure.

As shown in FIGS. 1-4 the pipe section 106 may include a mounting block 112 disposed thereon, the mounting block 112 having a recess 114 formed in the mounting block 112 for receiving and supporting the hanger arm 108. As shown in FIGS. 1, 2 and 5, the hanger arm 108 may fit into and/or mate with the recess 114 of the mounting block 112 for supporting the hanger arm 108 in the non-vertical or horizontal orientation 110. Further, FIG. 3 shows that the recess 114 may open out of the mounting block 112 at a first longitudinal end 308 of the recess 114 and in FIG. 4 along one longitudinal side 310 of the recess 114. The hanger arm 108 may selectively slide in and out of the longitudinal side opening of the recess 114 along the longitudinal side 310 of the recess 114, to selectively secure and attach the hanger arm 108 in the recess 114. Once slid into the recess 114 to cause the hanger arm 108 to be removably attached to the mounting block 112, the hanger arm 108 may be supported in the non-vertical orientation 110 (FIG. 1) such that the hanger arm 108 does not slide longitudinally out of the first longitudinal end 308 of the recess 114. As such, one end of the hanger arm 108 remains mated in the recess 114 while the hanger arm 108 is removably attached to the mounting block 112. The hanger arm 108 may be selectively laterally slid out of the recess 114 through the longitudinal side 310 of the recess 114 when a user desires to disassemble the hanger arm 108 from the pipe section 106 for storage.

As seen in FIGS. 1, 2, 6 and 7, the hanger arm 108 may have a longitudinal axis 116 extending along a length direction of the hanger arm 108. Further, as shown in FIG. 5, a cross section 502 of the hanger arm 108 taken across the longitudinal axis 116 may have a profile corresponding to a cross section profile 316 (FIG. 3) of the recess 114 for permitting the hanger arm 108 in being inserted into the recess 114 and being held in the recess 114 for allowing hangers to be supported by the hanger arm 108 against the force of gravity. For example, FIG. 5 shows that the hanger arm 108 may have a longitudinal end 504 having an enlarged cross section 502, and FIG. 3 shows that the recess 114 may have a second longitudinal end 318 having an enlarged cross section 316 corresponding to the enlarged cross section 502 of the hanger arm 108. For example, the enlarged cross sections 502 and 316 of the hanger arm 108 and recess 114, respectively, may have a greater or increased lateral dimension (in a lateral direction relative to the longitudinal axes, respectively) along a portion of the respective longitudinal axes. For example, an enlarged portion 502 of the hanger arm 108 may be located at a longitudinal end 504 of the hanger arm 108, and may have a lateral dimension that is increased or greater relative to a lateral dimension adjacent to the enlarged portion 502 along a longitudinal axis 116 of the hanger arm (e.g. adjacent the enlarged portion towards an opposite end). The enlarged portion 316 of the recess 114 may have a lateral dimension that is increased or greater relative to a lateral dimension of the recess 114 adjacent to the enlarged portion 316 along longitudinal axis 312 of the recess 114, to match the enlarged portion 502 of the hanger arm 108. When the hanger arm 108 is supported in the mounting block 112, the longitudinal axis 312 of the recess 114 and the longitudinal axis 116 of the hanger arm 108 may be co-linear, co-planar, and/or in-line. As a non-limiting example, the cross section profiles of the hanger arm 108 and the recess 114 may resemble a cross or a "plus-sign", where one dimension of the cross is the above described enlarged cross section and the remaining dimension of the cross is co-linear with respective longitudinal axes.

The shape or cross section profiles of the recess 114 and the hanger arm 108 may be configured to prevent the hanger arm 108 from falling out of the recess 114 and the mounting block 112 due to gravity. As such from a side view (FIGS. 1 and 5) of the recess 114, the hanger arm 108 and the recess 114 may fit together, or mate, like puzzle pieces. The hanger arm may friction-fit into the recess to enhance stability. Once the hanger arm 108 is secured in the mounting block 112, torque applied upward or downward, and longitudinal forces applied to the hanger arm 108, will be resisted by the mounting block 112 due to the configuration of the cross section profiles of the hanger arm 108 and the recess 114 being intentionally configured to mate as described herein. When the hanger arm 108 is placed in the recess 114, the hanger arm 108 substantially fills the recess 114 and extends from the enlarged cross section 316 of the recess 114 through the longitudinal end 308 of the recess 114 that opens out of the mounting block 112.

The enlarged cross section 316 of the recess 114 and/or the hanger arm 108 may be taken perpendicular to the longitudinal axes of the recess 114 and/or hanger arm 108, respectively. Further, the enlarged cross section 316 of the recess 114 and/or the hanger arm 108 may be taken parallel to the longitudinal axes of the recess 114 and/or the hanger arm 108, respectively. For example, as shown in FIG. 3, the longitudinal axis 312 of the recess 114 may extend from one longitudinal end 308 of the recess 114 to an opposite longitudinal end 318 of the recess. Turning to FIGS. 1, 2, 6, and 7, the longitudinal axis 116 of the hanger arm 108 may extend from one longitudinal end 504 of the hanger arm 108 to an opposite longitudinal end 506 of the hanger arm 108. Further, turning back to FIG. 3, a longitudinal axis 314 of the pipe section 106 may extend between one end (first open end 302) of the pipe section 106 and an opposite end (second open end 306) of the pipe section 106.

In some embodiments, the hanger arm 108 may have notches 702 (FIG. 7) or loops formed in the hanger arm 108 for seating or supporting one or more hangers.

It is to be understood that in the horizontal configuration (FIG. 1), the longitudinal axis 116 of the hanger arm 108, or the longitudinal axis 312 of the recess 114 may or may not be level or parallel with respect to the floor or ceiling while the hanger arm 108 is supported by the pipe section 106, and may be non-parallel, non-vertical, and/or non-horizontal with respect to the floor or ceiling while being supported by the pipe section 106. As such, the pipe section 106 and the recess 114 may be shaped and configured to achieve a desired orientation or angle of the hanger arm 108 while the hanger arm 108 is supported in the pipe section 106. For example, as seen in FIG. 3, an angle between the longitudinal axis 312 of the recess 114 and the longitudinal axis 314 of the pipe section 106 may be approximately 45 degrees. As a non-limiting example, with a 45 degree angle between the longitudinal axis 312 of the recess 114 and the longitudinal axis 314 of the pipe section 106, if the shower pipe 102 extends at a 45 degree angle relative to a wall from which the shower pipe 102 passes through, the hanger arm 108 would be supported horizontal and parallel with respect to the ceiling or floor in which the shower is installed as shown in FIG. 1.

In another embodiment, the above described pipe section 106 may instead be a clamp for externally clamping onto the shower pipe 102, where the clamp includes a mounting block 112 and recess as described above, disposed in or on the clamp.

In other words, the above described pipe section may be invariably considered a base that fits in-line and intermediate between the shower pipe and the shower head, and the hanger arm may releasably connect to the base via a bayonet type connection.

In conclusion, disclosed is a convenient device that allows users to hang items such as clothing from a shower pipe to remedy the problems described in the background section.

I claim:

1. A shower head assembly comprising:

a pipe section having a first end with a threaded female connection for attaching to a shower pipe and a second end with a threaded male connection for attaching a shower head device, said pipe section including a mounting block disposed thereon, said mounting block having a recess formed therein, said recess opening out of said mounting block at a longitudinal end of said recess and along one longitudinal side of said recess; and a hanger arm having a longitudinal axis extending along a length direction of said hanger arm, a cross section of said hanger arm taken along said longitudinal axis having a profile corresponding to a recess cross section profile for permitting said hanger arm for being inserted into said recess and held therein, said hanger arm having a longitudinal end with an enlarged cross section relative to an adjacent portion of said hanger arm, said recess having a second longitudinal end having an enlarged recess cross section relative to an adjacent portion of said recess, said enlarged recess cross section corresponding to said enlarged cross section of said hanger arm.

2. The shower head assembly according to claim 1, wherein said enlarged cross section is taken perpendicular to said longitudinal axis.

3. The shower head assembly according to claim 1, wherein said enlarged cross section is taken parallel to said longitudinal axis.

4. The shower head assembly according to claim 1, wherein said hanger arm has notches formed therein for seating a hanger.

5. A shower head assembly attachable to a shower pipe for supporting clothes hangers, the shower head assembly comprising:

a pipe section having a mounting block and a recess formed in the mounting block, said recess having longitudinal end opening opening out of said mounting block at a longitudinal end of said recess and said recess having a longitudinal side opening opening out along one longitudinal side of said recess; and a hanger arm removably insertable into the recess through said longitudinal side opening for being removably attached to the pipe section, said hanger arm projecting out of said longitudinal end opening, the hanger arm having a longitudinal axis extending along a length direction of said hanger arm and along said longitudinal side opening, a cross section of said hanger arm taken along said longitudinal axis having a profile corresponding to a recess cross section profile of the recess for permitting said hanger arm for being inserted into said recess and held therein, and the pipe section being configured to attach to the shower pipe and receive the hanger arm such that the hanger arm is supported in a non-vertical orientation against the force of gravity by the pipe section for supporting one or more clothes hangers on the hanger arm while the pipe section is attached to the shower pipe and while the hanger arm is adopting a horizontal orientation.

6. The shower head assembly according to claim 5, wherein said recess opens out of said mounting block at a longitudinal end of said recess and along one longitudinal side of said recess.

7. The shower head assembly according to claim 6, wherein said hanger arm has a longitudinal end with an enlarged cross section relative to an adjacent portion of said hanger arm, said recess having a second longitudinal end having an enlarged recess cross section relative to an adjacent portion of said recess, said enlarged recess cross section corresponding to said enlarged cross section of said hanger arm.

8. The shower head assembly according to claim 7, wherein said enlarged cross section is taken perpendicular to said longitudinal axis.

9. The shower head assembly according to claim 7, wherein said enlarged cross section is taken parallel to said longitudinal axis.

10. The shower head assembly according to claim 7, wherein the enlarged cross section of the hanger arm has a lateral dimension greater than an adjacent lateral dimension along the longitudinal axis of the hanger arm.

11. The shower head assembly according to claim 7, wherein the enlarged recess cross section has a lateral dimension greater than an adjacent lateral dimension along a longitudinal axis of the recess, the longitudinal axis of the recess extending between one longitudinal end of the recess and an opposite longitudinal end of the recess.

12. The shower head assembly according to claim 5, wherein said hanger arm has notches formed therein for seating a hanger.

* * * * *